US008925558B2

(12) United States Patent
Johnson

(10) Patent No.: US 8,925,558 B2
(45) Date of Patent: Jan. 6, 2015

(54) DEVICE AND METHOD FOR APPLYING MAKEUP

(71) Applicant: Pamela Johnson, Weston, FL (US)

(72) Inventor: Pamela Johnson, Weston, FL (US)

( * ) Notice: Subject to any disclaimer, the term of this patent is extended or adjusted under 35 U.S.C. 154(b) by 81 days.

(21) Appl. No.: 13/752,522

(22) Filed: Jan. 29, 2013

(65) Prior Publication Data

US 2014/0209114 A1 Jul. 31, 2014

(51) Int. Cl.
*A45D 40/00* (2006.01)
*A45D 37/00* (2006.01)

(52) U.S. Cl.
CPC ..... *A45D 40/00* (2013.01); *A45D 37/00* (2013.01)
USPC ..... 132/200; 132/320

(58) Field of Classification Search
CPC combination set(s) only.
See application file for complete search history.

(56) References Cited

U.S. PATENT DOCUMENTS

| | | | | |
|---|---|---|---|---|
| 1,850,540 A | | 3/1932 | Erickson | |
| 1,873,928 A | | 8/1932 | Bohner | |
| 3,789,856 A | | 2/1974 | Bomba | |
| D252,890 S | * | 9/1979 | Cavalieri | D28/7 |
| 5,050,624 A | | 9/1991 | Kobe | |
| D467,034 S | * | 12/2002 | Jaggers | D28/7 |
| 6,640,814 B1 | | 11/2003 | Burke | |
| D574,555 S | | 8/2008 | Yoo | |
| 2003/0094184 A1 | | 5/2003 | Parsons | |
| 2004/0255971 A1 | * | 12/2004 | Houghton | 132/319 |
| 2009/0183747 A1 | * | 7/2009 | Salicunaj | 132/200 |

* cited by examiner

*Primary Examiner* — Robyn Doan
(74) *Attorney, Agent, or Firm* — Feldman Gale, P.A.; Rafael Perez-Pineiro; A. Robert Weaver

(57) ABSTRACT

A device for applying first and second makeup material to a skin surface as well as a method for applying a first and second makeup material using a device is provided in accordance with the disclosure. The device includes a template body and an absorbent backing attached to the rear side of the template body. The backing is compressible and dimensioned to conform to the contours of a skin surface, such as the area below the eye and proximate the cheek. The template body includes an upper edge which, when contacted with the skin surface, screens adjacent skin surfaces areas. A first makeup material may then be applied above the upper edge while a second makeup material is released to the skin area below the upper edge as the backing is pressed against the skin surface. The template may then be removed and the first and second makeup materials may then be blended together to create a desired ornamental effect.

9 Claims, 5 Drawing Sheets

FIG. 5A
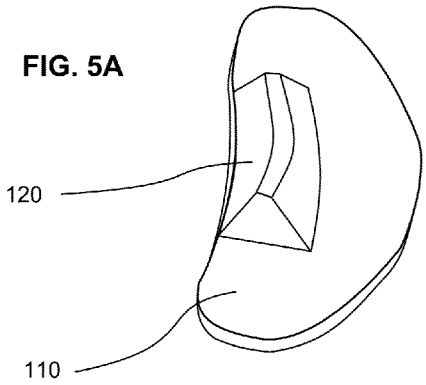
FIG. 5B
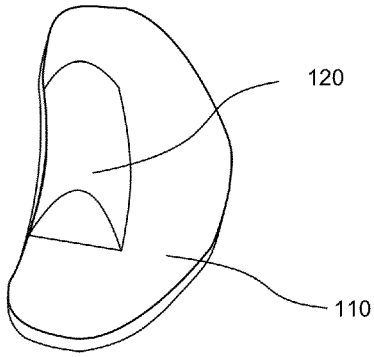
FIG. 5C
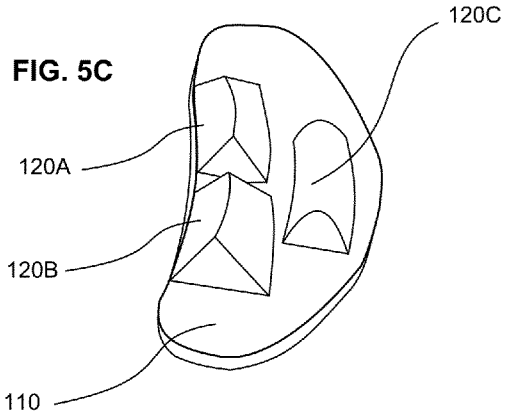
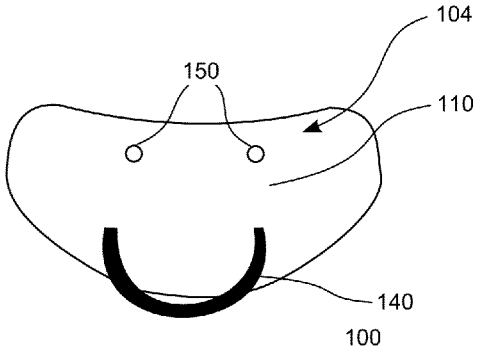
FIG. 5D
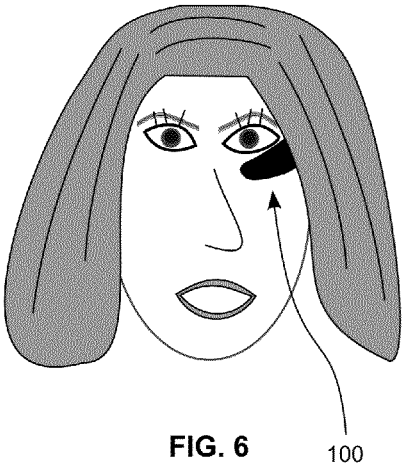
FIG. 6
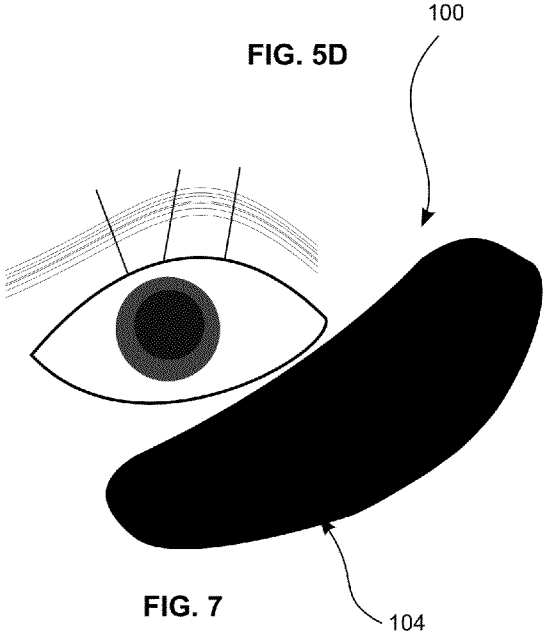
FIG. 7

FIG. 8
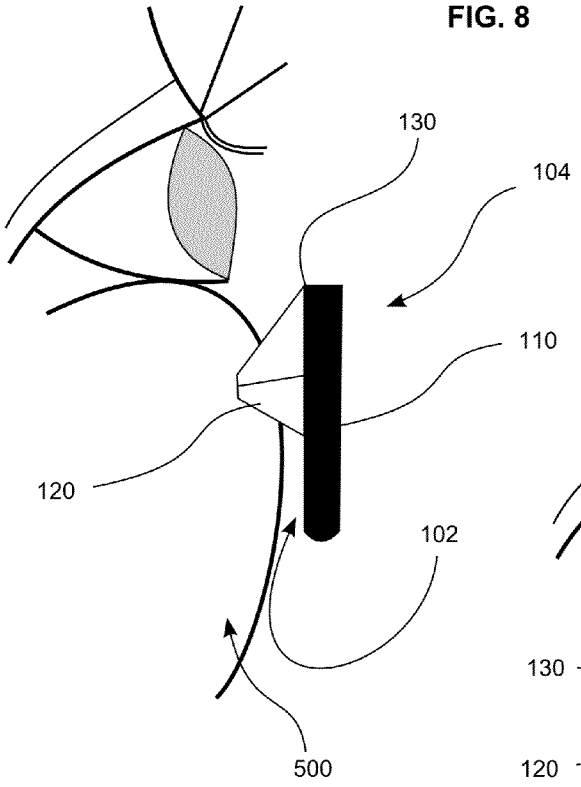
FIG. 9
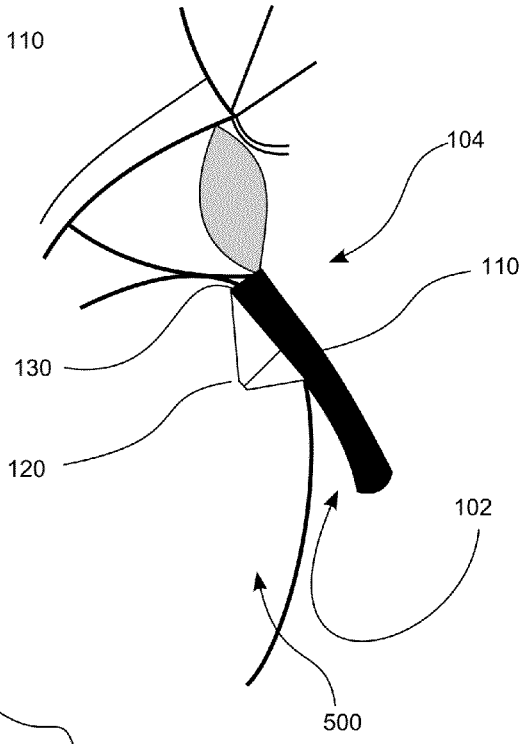
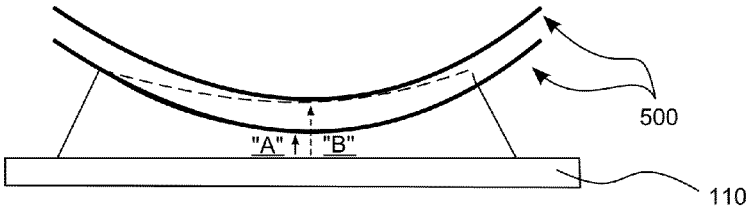
FIG. 10

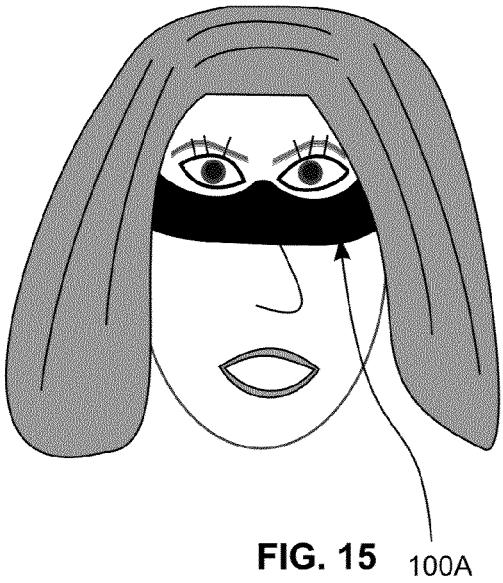
FIG. 15
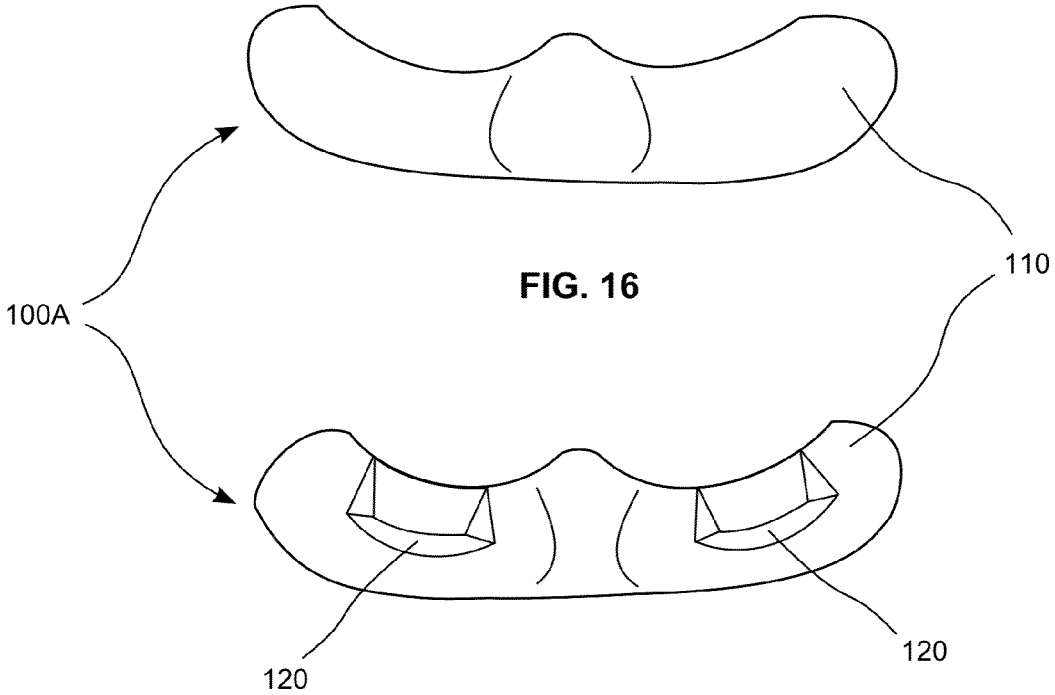
FIG. 16
FIG. 17

DEVICE AND METHOD FOR APPLYING MAKEUP

FIELD OF THE INVENTION

The invention relates to the application of facial makeup, and more particularly to devices and methods for masking during application of makeup.

BACKGROUND OF THE INVENTION

A variety of facial makeup materials are commonly used for creating a desired ornamental effect, including blushes, highlighters, powders, glosses, and so forth. These may be applied through commonly known and utilized brushes, stencils, pads, and other makeup application tools. Makeup artists may combine a variety of materials in order to obtain an ornamental makeup effect as desired. One such effect around the eyes is a shadowing effect to create an ornamental, textured appearance using at least two different kinds or colors of makeup which are blended at their boundary. Application of these materials often requires critical attention to detail, and it can be difficult to self-apply the material.

SUMMARY OF THE INVENTION

A device for applying makeup, in accordance with the disclosure, includes a template body having opposed front and rear sides with an upper and lower edge; and an absorbent backing attached to the rear side of the front portion, the absorbent backing substantially constructed from an absorbent material for retaining a makeup material as well as a compressible material for releasing the retained makeup material when the absorbent backing is compressed, the absorbent backing having a makeup application edge defined as the edge of the absorbent backing furthest from the rear side of the template body, the makeup application edge conformable to a contoured skin surface as the absorbent backing is pressed against the contoured skin surface.

Embodiments of the device may feature the thickness of the absorbent backing as greater than the thickness of the template body. The upper edge of the template body may have a bent curvature in the direction towards the lower edge thereby providing an indentation in the upper edge. The lower edge may further bend away from the upper edge, the template body thereby having a kidney bean shape. The upper edge of the absorbent backing may be positioned adjacent to the upper edge of the template body, the upper edge of the template body having a curvature conforming with the curvature of the upper edge of the template body. The makeup application edge of the absorbent backing may also have a bent curvature towards the rear side of the template body. The makeup application edge of the absorbent backing may include an additional curvature in substantially the same direction as the curvature of the upper edge of the template body.

Additional embodiments of the device of the disclosure may further include a fastener for securing the absorbent backing to the template body. Embodiments may also include a handle provided on the template body for grasping by the hand of a user. The device may further include an additional absorbent portion attached to the rear side of the template body. Embodiments featuring an additional absorbent portion attached to the rear side of the template body, the additional absorbent portion having substantially the same dimensions as the absorbent backing.

A method for applying first and second makeup materials to a skin surface of a user, in accordance with the disclosure, includes providing a device for applying makeup, the device including a template body and an absorbent backing attached to a rear side of the template body, the template body having an upper edge, the absorbent backing substantially constructed from an absorbent and compressible material, the absorbent backing having a makeup application edge spaced from the rear side of the template body; absorbing the second makeup material into the absorbent backing; pressing the absorbent backing against an area of the skin surface, the absorbent backing thereby compressing in order to conform to the area of the skin surface and apply the second makeup material onto the area of the skin surface; contacting the upper edge of the template body with the skin surface thereby screening the area of the skin surface from an adjacent area of the skin surface; applying a first makeup material proximate to the adjacent area of the skin surface, the upper edge of the template body operating to prevent the first makeup material from being applied to the area of the skin surface; and removing the device.

Embodiments of the disclosure for applying first and second makeup materials to a skin surface of a user, in accordance with the disclosure, may further include the first and second makeup materials having different shadings, contrast, or colors. The may also include blending the first and second makeup materials after removing the device. Additionally, the makeup application edge may be pressed against the area of the skin surface during the pressing step.

A method for applying first and second makeup material to a facial surface of a user, in accordance with the disclosure, includes providing a device for applying makeup, the device including a template body and an absorbent backing attached to a rear side of the template body, the template body having an upper and lower edge, the absorbent backing substantially constructed from an absorbent and compressible material, the absorbent backing having a makeup application edge spaced from the rear side of the template body; absorbing the second makeup material into the absorbent backing; pressing the absorbent backing against an area of the facial surface below the eye and on a skin surface proximate the cheek of the user thereby compressing in order to conform to the skin surface proximate the cheek and apply the second makeup material onto the skin surface proximate the cheek of the user; contacting the upper edge of the template body with the facial surface below the eye thereby screening the skin surface proximate the cheek of the user from the eye and a facial surface area laterally adjacent to the eye; applying a first makeup material proximate to the facial surface area adjacent the eye and the contacted upper edge, the upper edge of the template body operating to prevent the first makeup material from being applied to the area of the facial surface below the eye and above or over the cheek; and removing the device.

Embodiments of the disclosure for applying first and second makeup material to a facial surface of a user may further feature a portion of the upper edge extending laterally beyond the edge of the eye during the contacting step. They also feature the upper edge of the template body has a bent curvature in the direction towards a lower edge of the template body thereby providing an indentation in the upper edge. The method may additional include the makeup application edge of the absorbent backing having a bent curvature towards the rear side of the template body, the curvature conforming to the facial surface area pressed against the absorbent backing. Additionally, the device may further include an additional absorbent backing attached to the rear side of the template, the method further comprising absorbing a third makeup material into the additional absorbent backing, the absorbent backing and additional absorbent backing mutually pressed against the facial surface thereby applying both the second and third makeup material.

Embodiments of the device for applying makeup, also referred to as a makeup template, may be used with embodiments of the methods for applying makeup material, in accordance with the disclosure.

BRIEF DESCRIPTION OF THE DRAWINGS

A more complete understanding of the present invention, and the attendant advantages and features thereof, will be more readily understood with reference to the following detailed description, when considered in conjunction with the accompanying drawings, wherein:

FIG. 5A depicts a perspective view of an additional embodiment of a device for applying makeup of the disclosure;

FIG. 5B depicts a perspective view of an additional embodiment of a device for applying makeup of the disclosure;

FIG. 5C depicts a perspective view of an additional embodiment of a device for applying makeup of the disclosure;

FIG. 5D depicts a front view of an additional embodiment of a device for applying makeup of the disclosure;

FIG. 6 depicts a front view of the device of FIG. 1 positioned against a user's face in accordance with the disclosure;

FIG. 7 depicts an expanded front view of FIG. 6;

FIG. 8 depicts a side view of the device of FIG. 1 positioned against a user's face in a pre-application position;

FIG. 9 depicts a side view of the device of FIG. 1 positioned against a user's face in an application position;

FIG. 10 depicts a bottom view of the device of FIG. 1 pressed against a user's skin surface;

FIG. 15 depicts a front view of an additional embodiment of a device for applying makeup of the disclosure positioned against a user's face;

FIG. 16 depicts a front view of the device of FIG. 14; and

FIG. 17 depicts a rear view of the device of FIG. 14.

DETAILED DESCRIPTION OF THE INVENTION

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the present subject matter in virtually any appropriately detailed structure and function. Further, the terms and phrases used herein are not intended to be limiting, but rather, to provide an understandable description of the concepts.

The terms "a" or "an", as used herein, are defined as one or more than one. The term plurality, as used herein, is defined as two or more than two. The term another, as used herein, is defined as at least a second or more. The terms "including" and "having," as used herein, are defined as comprising (i.e., open language). The term "coupled," as used herein, is defined as "connected," although not necessarily directly, and not necessarily mechanically.

Figure 1:
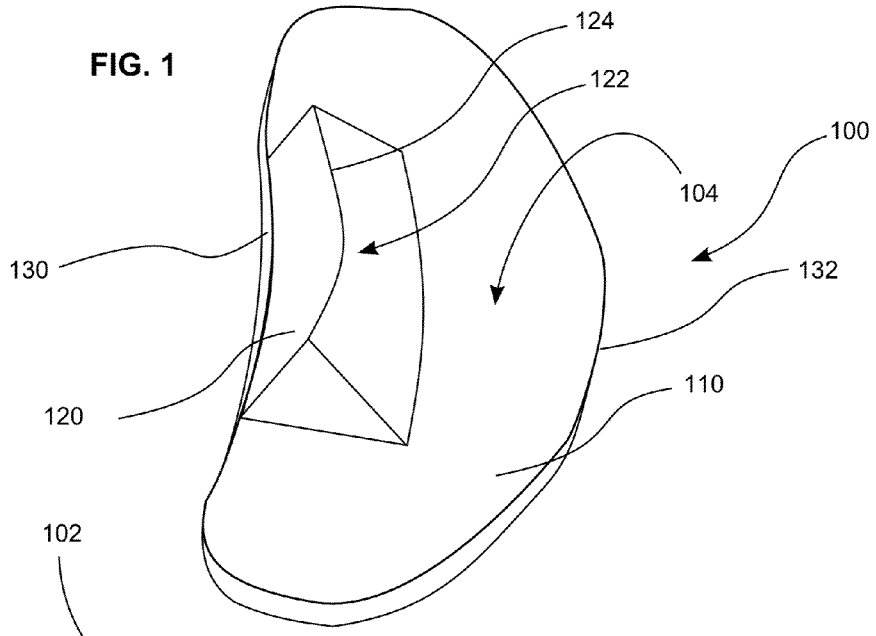
FIG. 1 depicts a perspective of a device for applying makeup of the disclosure.
Figure 2:
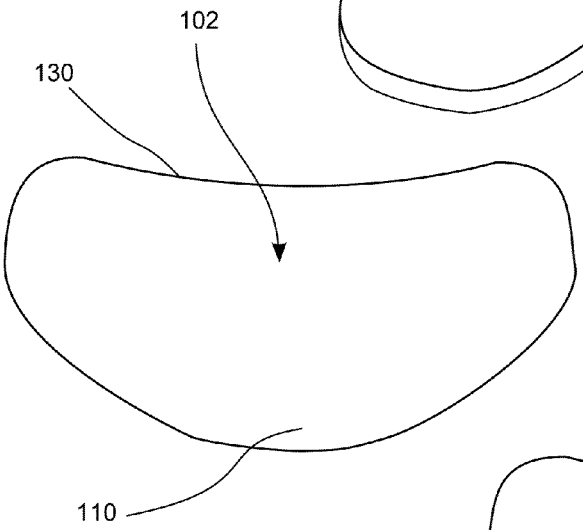
FIG. 2 depicts a front view of the device of FIG. 1.
Figure 3:
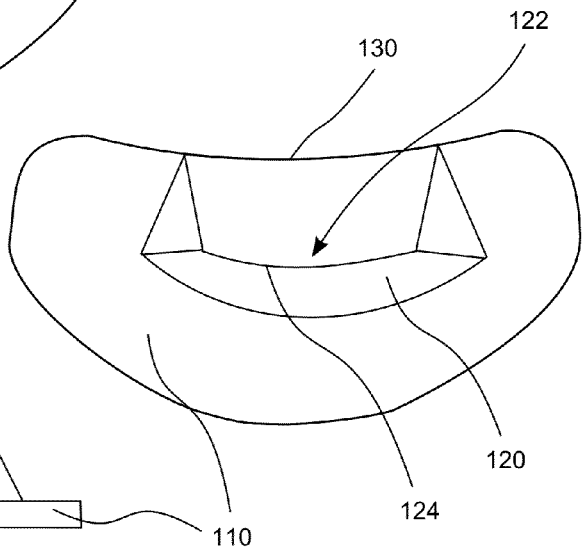
FIG. 3 depicts a rear view of the device of FIG. 1.
Figure 4:
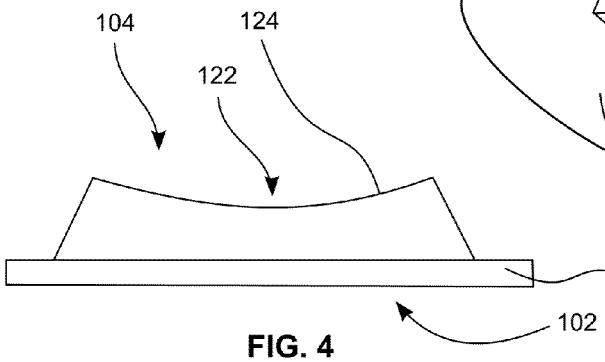
FIG. 4 depicts a bottom view of the device of FIG. 1.

In reference now to FIGS. 1-5, a device for applying makeup, or makeup template 100, includes a template body or first portion 110 with an absorbent backing or absorbent backing 120 attached to a rear side 104 of template 100, the template body having front and rear sides 102, 104 with upper and lower edges 130, 132. Absorbent backing 120 is smaller than template body 110 in many embodiments, including the illustrated embodiments, however it should be appreciated that absorbent backing may extend across the entire rear side 104 of template body or past an edge of template body 110, other than past upper edge 130 which could interfere with forming a sealing surface. First and second portions 110, 120 may be separable, individual components secured together, as shown in the illustrated embodiment, or may be manufactured as a single integral component. It should be appreciated that a variety of securing methods, such as a known or to be developed adhesive or a fastener, are contemplated within the disclosure for securing first and second portions 110, 120 to each other. An example fastener 150 is shown in FIG. 5D, which may be a screw or pin for example, extending from the front side 102 to the rear side 104 of template body 110 and securing template body 110 with absorbent backing 120. In some embodiments, absorbent backing 120 is easily removable, by removing fastener 150 for example, in order to wash, clean, or dispose either first or second portion 110, 120. In other embodiments first and second portions 110, 120 may be manufactured integrally together or connected so that they may not be separable, by adhesive for example.

Template body 110 may be constructed from a rigid or semi-rigid material while absorbent backing 120 may be constructed from an absorbent or sponge material. In one embodiment, the material of template body 110 is a plastic, such as polyethylene which is low cost and easy to manufacture. A coating may be further provided over template body 110, on either front or rear sides 102, 104, in order to protect the template body 110 from degradation due to repeated exposure to makeup chemicals, inks, and dyes as well oils and dirt collected from repeated touching and grasping by a user. A coating may additionally protect template body from the adverse effect of exposure to cleaning chemicals or soaps for washing template 100 so that template body 110 and/or template 100 may be reused with various makeup types. In some embodiments, a handle 140 may be included, for instance on a portion of front side 102 as illustrated in FIG. 5D, to aid a user grasping template 100 and applying the facial makeup. Alternatively, template 100 may be constructed with only first and second portions 110, 120, which for instance reduces the manufacturing cost of template 100 thereby encouraging disposability rather than reusability of template 100.

Absorbent backing 120 may be constructed from a sponge, absorbent, or porous material for absorbing and applying a facial makeup 202, such as blush, foundation, concealer, bronzer, powder, or other known or to be developed facial makeup. Embodiments of absorbent backing 120 may be constructed from cotton, artificial fiber, plastic polymers, polyester, or other known or to be developed porous material operable to apply a facial makeup when pressed against the skin. Accordingly, absorbent backing 120 has a dual functionality of both applying a facial makeup as well as comfortably and fittingly conforming rear side 104 of template 100 to a person's face. Although the skeletal and tissue structure of the face is variable from person to person, the compressible nature of the absorbent material of absorbent backing 120 permits template 100 to fit against a variety of skin surfaces.

The shape and dimension of both first and second portions 110, 120 are designed to comfortably and securely conform to a portion of a user's face when template 100 is pressed against the user's face in accordance with the disclosure. Template body 110 is illustrated roughly having a kidney bean shape, with an indentation or bend at a top or upper edge 130 for establishing a sealing edge or surface of template 100, the indentation and shape facilitating upper portion 110 conforming to the facial anatomy of the user. The shape of portions 110, 120 may be symmetrical, or substantially symmetrical, to facilitate use of template 100 proximate both the right and left eye. The indentation in sealing edge 130 permits template 100 to conform to the contours of a person's face, for instance above or over the cheek bone and below the eye as shown and described herein. The width of template body 110, defined as the greatest distance between the lateral side of template body 110, may be greater than 0.75 inches wide, and is 3 inches wide in an exemplary embodiment. Furthermore, the height of template body 110, defined as the greatest distance from upper edge 130 to an opposite lower edge 132, may be between 0.5 inches and 3 inches, and is 1.75 inches in an exemplary embodiment. A width of 0.75 inches or greater permits template 100 to extend a distance beyond the lateral edge of the user's eye in accordance with a method of applying facial makeup as described herein. Although very wide template bodies 110 are contemplated within the disclosure, it is likely that a width greater than 4 inches would extend beyond the cheek bone and into the hairline of the majority of users. Template body 110 is also contemplated within the disclosure as having a very long or narrow height, however a height of less than 0.5 inches would likely result in a thin template body 110 with little room for securing absorbent backing 120 to the rear side 104, while a height of greater than 3 inches would likely extend well past the upper edge of the cheek bone. The thickness of template body 110, defined as the distance between front side 102 and rear side 104, may be paper thin or have a thickness of several inches. Furthermore, template body may be substantially flat or planar, or may have a slight bend, as viewed from a side view, in order to facilitate establishing upper surface 130 as a sealing edge (as illustrated in FIG. 9, for example, and discussed further herein). Accordingly, template body 110 may have a side curvature, defined as the furthest distance between front side 102 and rear side 104 less the thickness of template body 110, of up to 2 inches, and is 0.375 inches in one embodiment. In some embodiments this curvature may result in simultaneous contact by edge 124 of absorbent backing 120 and edge 130 of template body 110 against a skin surface, however template body 110 should not have such a pronounced curvature so as to interfere with the pressing or contact of absorbent backing 120 against a skin surface. FIG. 9 illustrates this side curvature occurring as a result of an elastic deformation when upper edge 130 is pressed against the skin surface, which may occur in embodiments where template body 110 is constructed from a semi-rigid material, however it should be understood that this side curvature may also be an inherent dimension of template body 110.

Absorbent backing 120 is illustrated as roughly having a prism shape with a middle bend 122 along a makeup application edge 124, defined as the surface or edge spaced furthest from template body 110 which may be pressed against a user's face. The thickness, height, and width of absorbent backing 120 are defined in the same direction as template body 110. The width of absorbent backing 120 may be between 0.5 inches and 3.75 inches, and is 2.5 inches in an exemplary embodiment. The length of absorbent backing 120 may be between 0.25 inches and 2.5 inches, and is 0.5 inches in an exemplary embodiment. The thickness of absorbent backing 120 may be between 0.1 inches and 2 inches, and is 0.5 inches in an exemplary embodiment. In many embodiments, absorbent backing 120 will have a smaller width and length than template body 110 and a greater thickness than template body 110. As application edge 124 is the edge or surface of absorbent backing 120 extending furthest from rear side 104, it can be the first surface or edge of absorbent backing 120 to contact a skin surface when template 100 pressed against the skin surface. Embodiments of template 100 may include an absorbent backing 120 having a greater thickness dimension than template body 110, so that absorbent backing 120 may hold a sufficient quantity of makeup material. A sufficient thickness additionally helps to ensure template body 110 does not interfere with the application of a makeup material from absorbent backing 120 along application edge 124.

As illustrated in FIGS. 5A and 5B, absorbent backing may be dimensioned into a variety of shapes, such as polygonal shape, an example embodiment shown in FIG. 5A, or a cylindrical shape, an example embodiment shown in FIG. 5B. Additionally, absorbent backing 120 may be provided as two or more components, such as portions 120A, 120B, and 120C shown in the embodiment of FIG. 5C. One or more absorbent backings may be positioned closely against the upper edge 130 of rear side 104, such as portions 120, 120A, 120B, or may be positioned on any portion of rear side 104, such as portion 120C. Varying embodiments can have relatively different surface area and shape of application edge 124, in order to enable a user to vary the dimensions and amount of makeup material applied, or to vary the surface area the makeup material is applied to. For example, edge 124 can be flat, angled, sharp edged, or ridged, and can have an oval, rectangular, linear, or other shaped profile.

Figure 11:
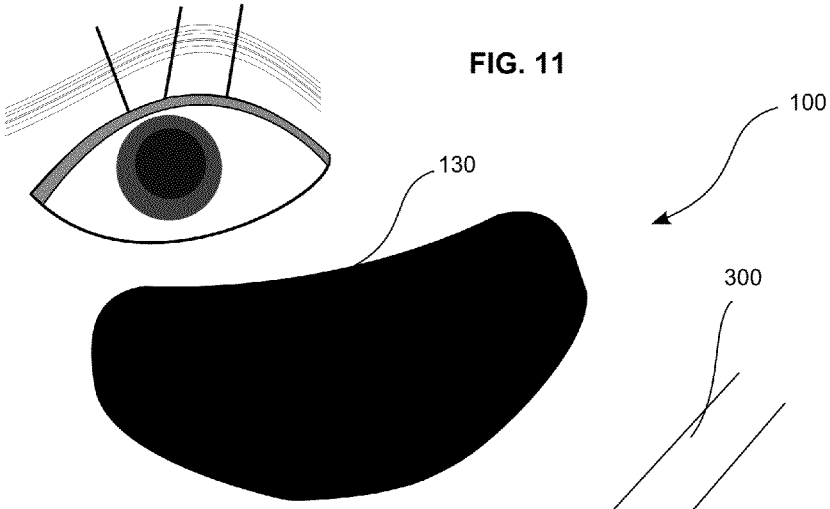
FIG. 11 depicts an expanded front view of the device of FIG. 1 positioned against a user's face in a pre-application position.
Figure 12:
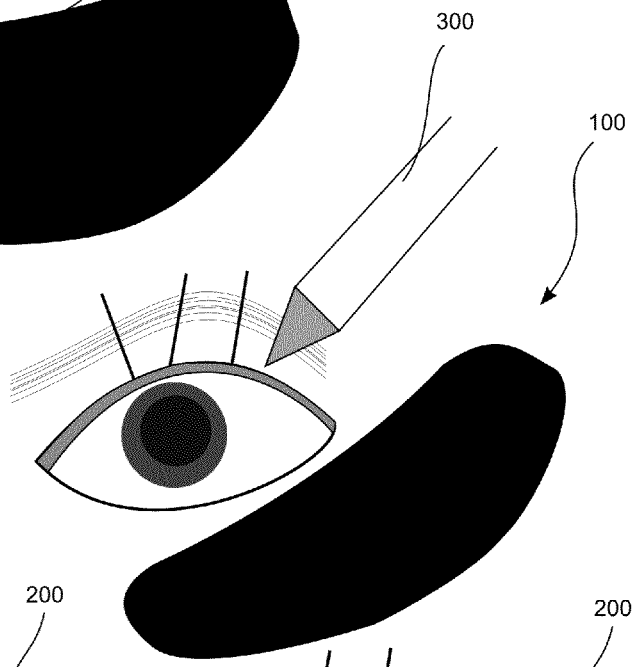
FIG. 12 depicts an expanded front view of the device of FIG. 1 positioned against a user's face in an application position.
Figure 13:
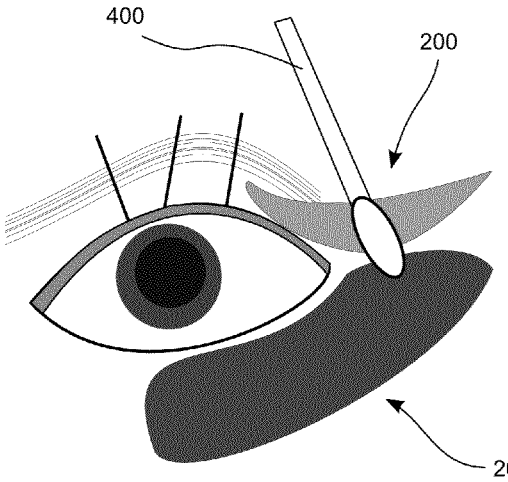
FIG. 13 depicts an expanded front view of a user's face post-application of a first and second facial makeup.
Figure 14:
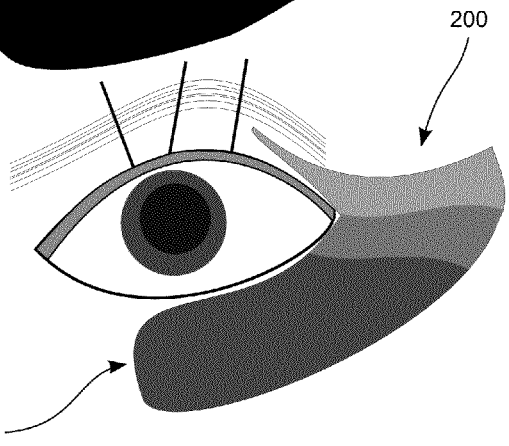
FIG. 14 depicts an expanded front view of a user's face post-blending of the first and second facial makeup.

In reference now to FIGS. 6-14, a method for applying facial makeup is described herein using makeup template 100. FIGS. 6-10 illustrate an embodiment of positioning template 100 against the face of a user, while FIGS. 11-14 illustrate an exemplary method for applying a first and second makeup 200, 202.

Template 100 may be positioned below the eye of a user and above or over the upper edge of the user's cheek bone, with upper edge 130 positioned adjacent the lower edge of the eye. In an embodiment of the method, template 100 is positioned so that template body 110 is slightly off-center from the user's eye so that when upper edge 130 is pressed against the face to contact the skin, upper edge 130 extends laterally beyond the outer edge of the eye. The indentation on the upper edge 130 of template body 110 permits the upper edge 130 to conform closely to the curvature of the eye, as well as the dimensions of absorbent backing 120 permit a second makeup to applied above or over the upper edge of the user's cheekbone just below the user's eye. In embodiments where absorbent backing 120 is positioned adjacent upper edge 130, template 100 may be tilted or rocked upwards towards the eye when pressed against the user's face so that upper edge 130 firmly contacts the skin surface.

Accordingly, a method for applying a first and second makeup may include the steps of providing makeup template 100, absorbing a second makeup 202 into absorbent backing 120, pressing absorbent backing 120 of template 100 against a user's face below the eye and over or above the cheek bone, the pressing thereby resulting in second makeup 202 being applied below the eye and over or above the cheek bone, titling template 100 so that an upper edge of template body 110 contacts the skin of the user and forms a sealing edge along the skin surface, applying a first makeup 200 on the facial skin surface above upper edge 130, which operates to seal applied first makeup 200 from applied second makeup 202, removing template 100 and blending first and second makeup 200, 202 in order to create a desired ornamental makeup effect using two different makeup shades. Template 100 may also be pressed to compress portion 120, so that portion 110 can contact the skin.

First makeup 200 may be applied with any known or to be developed makeup applicator 300, such as a stencil or brush, while first and second makeups 200, 202 may be blended using a user's fingers and/or with a known or to be developed blending tool 400, such as a brush or swab. The step of pressing upper edge 130 against the face in order to establish a seal may be defined as an application position of template 100. The result of the method for applying first and second makeups 200, 202 is an ornamental effect, such as a shadowing effect, using two different makeup shades or compositions, as selected by the user. In addition to using absorbent backing 120 for applying a second makeup 202, it is further contemplated that alternative material, such as water or a medicinal fluid, may be absorbed into absorbent backing 120 and applied instead of makeup 202. Also, in embodiments having multiple absorbent backings 120A, 120B, 120C, a third, fourth, or fifth material may be applied, one material per absorbent backing 120 provided, in order to create additional ornamental makeup effects as desired by the user.

As shown in FIG. 10, absorbent backing 120 is compressible against a user's contoured skin surface, such as cheek surface 500. Application edge 124 may be compressed from a distance "A" from rear side 104 to a distance "B from rear side 104. By having a compressibility of at least "B" minus "A", absorbent backing 120 may release a quantity of second makeup material 202, as well as potentially absorb a fluid from the skin surface in an alternate application. Additionally, the ability for backing 120 to elastically deform or compress permits backing 120 to fittably conform to the contours of a human face, for instance, thereby permitting template 100 to be used on a variety of surfaces. Compression of backing 120 results in application edge 124 contact and press against the entirety of a contoured skin surface, including the skin surface furthest from rear side 104 and closest to rear side 104. Absorbent backing 120 has a thickness between 0.5 and 3.75 inches to permit backing 120 to compress at least a distance "B" minus "A", as illustrated in FIG. 10. Indentation 122 further permits conformity of backing 120 to a skin surface when template 100 is pressed against the surface.

In an additional embodiment of template 100A, illustrated for example in FIGS. 15-17, template body 110 may extend over the bridge of the nose to proximately cover a facial surface area below both eyes and adjacent or over both cheek bones. In this additional embodiment, two absorbent backings 120 may be provided proximate to each eye in order to simultaneously apply a second makeup material 202 near both set of eyes. In template 100A, two indentations may be provided on upper edge 130 to facilitate conformation to the user's facial structure, particularly the set of eyes. A noise bridge may also be built into template body 110 for conforming to the user's nose.

Template 100 may also be utilized in applications other than applying facial makeup adjacent the eye and cheekbone, such as applying a medical cream or solution as well as applying makeup material to a non-facial area as examples. It is also within the disclosure that template 100 may be utilized in non-human applications such as for creating artistic works, such as paintings on a canvas or other surface. Also, it should be understood that the "cheek" or "cheekbone" as used herein refers generally to the facial surface area below the eye and extending from the edge of the nose around to the ear or hairline of the user as shown and described, and is not necessarily intended herein to be narrowly interpreted as the area directly over the zygomatic bone, for instance.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention.

All references cited herein are expressly incorporated by reference in their entirety. In addition, unless mention was made above to the contrary, it should be noted that all of the accompanying drawings are not to scale. There are many different features to the present invention and it is contemplated that these features may be used together or separately. Thus, the invention should not be limited to any particular combination of features or to a particular application of the invention. Further, it should be understood that variations and modifications within the spirit and scope of the invention might occur to those skilled in the art to which the invention pertains. Accordingly, all expedient modifications readily attainable by one versed in the art from the disclosure set forth herein that are within the scope and spirit of the present invention are to be included as further embodiments of the present invention.

REFERENCE LIST

100 makeup template
102 front side
104 rear side
110 template body
120 absorbent backing
122 bend
124 makeup application edge
130 upper edge
132 lower edge
140 handle
150 fastener
200 first makeup
202 second makeup
300 first makeup applicator tool
400 makeup blending tool
500 cheek skin surface

What is claimed is:

1. A method for applying first and second makeup materials to a skin surface of a user, the method comprising:

providing a device for applying makeup, the device including a template body and an absorbent backing attached to a rear side of the template body, the template body having an upper edge, the absorbent backing substantially constructed from an absorbent and compressible material, the absorbent backing having a makeup application edge spaced from the rear side of the template body;

absorbing the second makeup material into the absorbent backing;

pressing the absorbent backing against an area of the skin surface, the absorbent backing thereby compressing in order to conform to the area of the skin surface and apply the second makeup material onto the area of the skin surface;

contacting the upper edge of the template body with the skin surface thereby screening the area of the skin surface from an adjacent area of the skin surface;

applying a first makeup material proximate to the adjacent area of the skin surface, the upper edge of the template body operating to prevent the first makeup material from being applied to the area of the skin surface; and removing the device.

2. The method according to claim 1, wherein the first and second makeup materials have different shadings, contrast, or colors.

3. The method according to claim 1, further comprising blending the first and second makeup materials after removing the device.

4. The method according to claim 1, wherein the makeup application edge is pressed against the area of the skin surface during the pressing step.

5. A method for applying first and second makeup material to a facial surface of a user, the method comprising:

providing a device for applying makeup, the device including a template body and an absorbent backing attached to a rear side of the template body, the template body having an upper and lower edge, the absorbent backing substantially constructed from an absorbent and compressible material, the absorbent backing having a makeup application edge spaced from the rear side of the template body;

absorbing the second makeup material into the absorbent backing;

pressing the absorbent backing against an area of the facial surface below the eye and on a skin surface proximate the cheek of the user thereby compressing in order to conform to the skin surface proximate the cheek and apply the second makeup material onto the skin surface proximate the cheek of the user;

contacting the upper edge of the template body with the facial surface below the eye thereby screening the skin surface proximate the cheek of the user from the eye and a facial surface area laterally adjacent to the eye;

applying a first makeup material proximate to the facial surface area adjacent the eye and the contacted upper edge, the upper edge of the template body operating to prevent the firstmakeup material from being applied to the area of the facial surface below the eye and above or over the cheek; and removing the device.

6. The method according to claim 5, wherein a portion of the upper edge extends laterally beyond the edge of the eye during the contacting step.

7. The method according to claim 6, wherein the upper edge of the template body has a bent curvature in the direction towards a lower edge of the template body thereby providing an indentation in the upper edge.

8. The method according to claim 7, wherein the makeup application edge of the absorbent backing has a bent curvature towards the rear side of the template body, the curvature conforming to the facial surface area pressed against the absorbent backing.

9. The method according to claim 5, the device further including an additional absorbent backing attached to the rear side of the template, the method further comprising absorbing a third makeup material into the additional absorbent backing, the absorbent backing and additional absorbent backing mutually pressed against the facial surface thereby applying both the second and third makeup material.

* * * * *